US006349428B1

(12) United States Patent
Nasr et al.

(10) Patent No.: US 6,349,428 B1
(45) Date of Patent: Feb. 26, 2002

(54) PULLOUT HAND-HELD SHOWER

(75) Inventors: Nagib Nasr, Apex; William Davis Smith, Jr., Vanceboro; John Adam Griffin; Charles Allen McCormick, both of New Bern, all of NC (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/553,272

(22) Filed: Apr. 20, 2000

(51) Int. Cl.[7] ..... A47K 3/28
(52) U.S. Cl. ..... 4/570; 4/615
(58) Field of Search ..... 4/567, 570, 615

(56) References Cited

U.S. PATENT DOCUMENTS

| | | | | | |
|---|---|---|---|---|---|
| 824,454 | A | | 6/1906 | Vanderman | |
| 2,685,093 | A | * | 8/1954 | Lundquist | 4/615 |
| 2,697,839 | A | * | 12/1954 | Jackson | 4/615 |
| 3,005,995 | A | * | 10/1961 | Brickford | 4/615 |
| 3,110,038 | A | * | 11/1963 | Dornbierer | 4/570 |
| 3,616,466 | A | * | 11/1971 | Davis | 4/615 |
| 3,737,107 | A | * | 6/1973 | Wright | 239/588 X |
| 3,806,963 | A | * | 4/1974 | Flynn | 4/615 |
| 4,360,159 | A | * | 11/1982 | Haynes | 4/596 |
| 4,926,511 | A | | 5/1990 | Coll | |
| 5,027,450 | A | | 7/1991 | Lang | |
| 5,093,942 | A | | 3/1992 | Lang | |

* cited by examiner

*Primary Examiner*—Charles E. Phillips
(74) *Attorney, Agent, or Firm*—Cook, Alex, McFarron, Manzo, Cummings & Mehler, Ltd.

(57) ABSTRACT

A shower assembly for use as a stationary shower or a hand-held shower includes a housing, a hose and a shower head. The housing includes a plurality of sides, an inlet, and an at least one outlet where said housing is concealed behind a shower wall adjacent thereto and protects the shower wall from water damage. A hose is freely disposed within the housing having a first end connected to a water supply pipe, a second end connected to the shower head on the exposed side of the shower wall and defining a fluid engagement between the water supply pipe and the shower head. The hose is extractable from a housing outlet when the user pulls on the hose second end during use as a hand-held shower and is retractable into the housing during use as a stationary shower and the hose is concealed from the user's view. The shower head height may also be adjusted to user's desired height.

12 Claims, 4 Drawing Sheets

PULLOUT HAND-HELD SHOWER

FIELD OF THE INVENTION

The present invention relates to a shower for use as a conventional shower and as a hand-held shower. Shower users desire an enhanced shower experience and shower heads with a greater variety of features. One enhancement may involve giving the user the option of using the shower head as a typical stationary shower head or as a hand-held shower wand. During a typical shower with a stationary shower head, the user stands underneath the shower head which directs spray onto the user. Although a stationary shower allows a user's hands to be free, the user has difficulty cleaning certain areas and may have to contort his or her body because a stationary shower simply cannot reach all places. The hand-held shower allows the user to reach virtually anywhere but carries the disadvantage of always having to be held by the user. Thus, there is a need to combine the features of both showers.

The present invention combines the features of a stationary shower with those of a hand-held shower wand. The user is given the option of taking two different kinds of showers or a combination thereof. The invention provides for a conventional shower where the user's hands remain free and a hand-held shower where the user directs the shower spray to specific body areas. The stationary shower head is extractable from the shower wall to form a hand-held shower wand. The height of the shower head also may be adjusted.

SUMMARY OF THE INVENTION

The present invention relates to a shower assembly for use as a stationary shower head and a hand-held shower wand. During use as a stationary shower, the invention allows a user's hands to be free. During use as a hand-held shower, the user extracts the shower head from the shower wall and is free to direct the shower wand anywhere that he or she wants. The shower head is attached to a hose which is concealed behind the wall during stationary use but extractable from the wall during hand-held use. The height of the shower head also is adjustable to a desired user height. The user has the option of taking either a stationary shower or a hand-held shower. Alternatively, the user may prefer to take a shower which combines both features. Thus, the invention gives the user an enhanced shower experience.

A primary purpose of the invention is to provide a shower assembly which can be used either as a stationary shower or a hand-held shower.

Another purpose of the invention is to provide a combined stationary and hand-held shower which uses a hose to supply water to the user where the hose is concealed during use as a stationary shower and is extractable from the shower wall during hand-held use.

Another purpose of the invention is to provide a shower assembly which is securely mounted to the shower wall.

Another purpose of the invention is to provide a shower assembly which assists the user in the extraction and retraction of the hose from the shower wall.

Another purpose of the invention is to provide a stationary and hand-held shower which has an adjustable height.

A further purpose of the invention is to provide a stationary and hand-held shower which is pivotably adjustable.

Other purposes will appear in the ensuing specification, drawings and claims.

BRIEF DESCRIPTION OF THE DRAWINGS

The invention is illustrated diagrammatically in the following drawings wherein.

DETAILED DESCRIPTION OF THE PREFERRED EMBODIMENT

Figure 1:
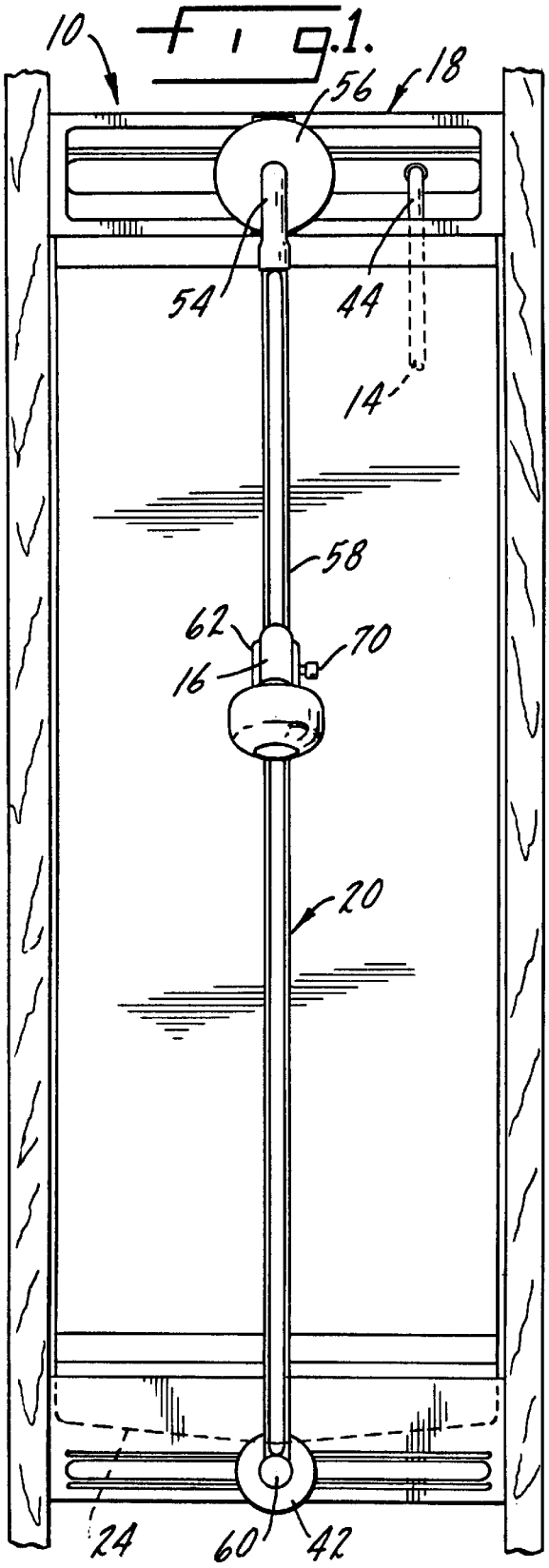
FIG. 1 is a front view of an adjustable shower assembly.

The present invention relates to a shower assembly which combines features of a stationary shower and a hand-held shower wand.

FIGS. 1 through 5 illustrate a shower assembly 10 of the present invention with an adjustable shower height. The assembly includes a housing 12, a hose 14, a shower head 16, a supporting section 18, and a shower arm assembly 20.

The housing 12 is located behind a shower wall 22 and includes a bottom 24 and a top 26. A first side or front 28 of the housing is generally planar and rests against the shower wall 22 and may have one or more recesses 30 to assist in positioning of the housing 12. A second side or rear wall 32 is located opposite the shower wall 22 and has an upper recess 34. The housing bottom 24 may be sloped to direct water to a drain outlet 36. A drain hose 38 is connected to the drain outlet 36 on one end and to the shower arm assembly 20 on the other. In this way the drain hose 38 directs any water in the housing 12 through an opening in the shower wall 22 and into the shower arm assembly 20 which is located on the other or exposed side of the shower wall 22. Water exits the shower assembly 10 through a fluid channel 40 of the shower arm assembly 20. The opening in the shower wall 22 is preferably masked by an escutcheon 42. The housing top 26 completely encases the housing 12 and protects it from debris which may accumulate behind the wall. The cover 26 also prevents debris from clogging the drain outlet 36 and prevents water damage which occurs therefrom.

The housing 12 defines a container which allows the hose 14 to be freely disposed therein and hang in any orientation such as a loop. A hose first end 44 connects to the water supply pipe 45 within the housing 12 at a housing inlet and the second hose end 46 connects to the shower head 16 on the exposed or user's side of the shower wall 22. As such the hose 14 is primarily concealed behind the shower wall when the hose is in its fully retracted position, but capable of being extending through a housing outlet during hose extraction. The housing 12 provides an environment which is water protective so that any water leakage which occurs at the water supply connection will drain into the housing. Thus, the housing prevents water damage to the shower wall. The hose 14 preferably is made of a durable material such as metal with a limited bend diameter to prevent the hose from kinking. Although any hose bend diameter is possible, the preferred bend diameter of the present invention is about 3".

Figure 4:
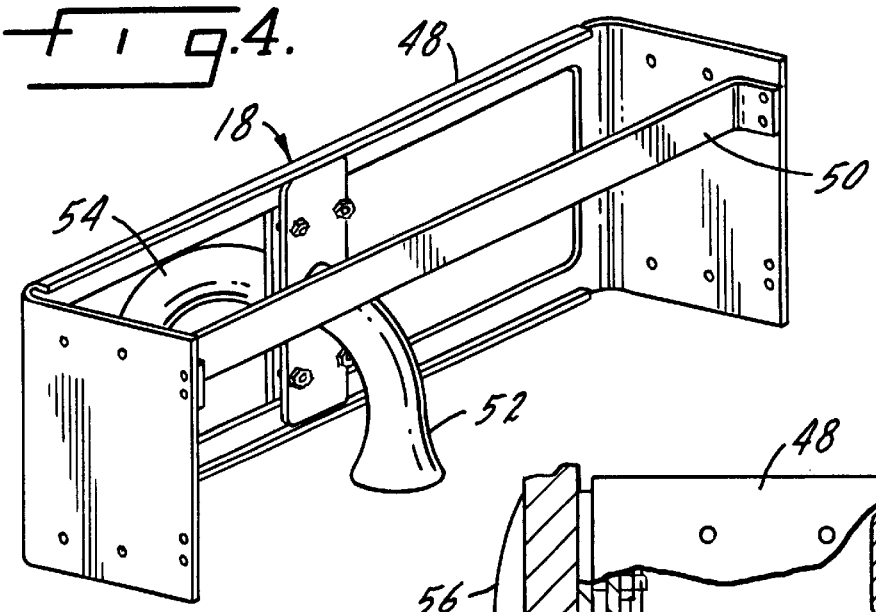
FIG. 4 is a perspective view of a support section of the invention shown in FIG. 1.
Figure 5:
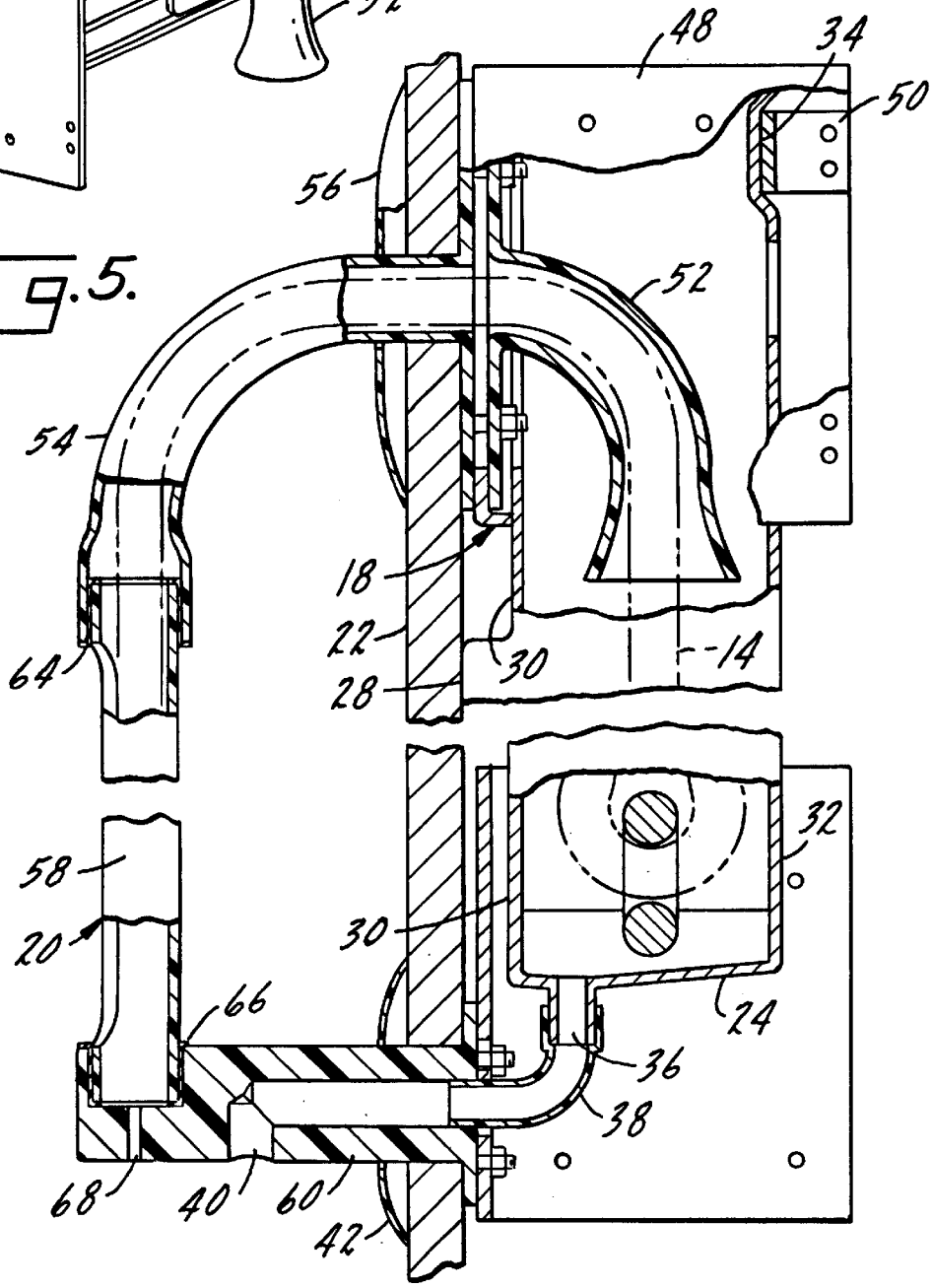
FIG. 5 is an enlarged partial side view, in part section.

The supporting section 18 provides support for the shower assembly 10 and guides the hose during use. Portions of the supporting section will be preferred to be hidden or concealed behind the shower wall or otherwise masked from the user's view whereas other portions will be visible to the user. FIGS. 4 and 5 show a supporting section which includes a U-shaped member 48 with a front edge having an opening therein and two side edges, a rear element 50, and one or more hose sleeves 52, 54 which are secured to the U-shaped member 48. From the housing 12, the hose extends from behind the shower wall 22 to the exposed side thereof through housing hose sleeves 52, 54. An escutcheon 56 may be used to mask the opening in the shower wall 22. The hose sleeves 52, 54 are located at an elevation that is approximate to standard shower head height and are made of rigid, durable materials such as metal although some types of plastic may be suitable.

Figures 3, 6, 7, 8:
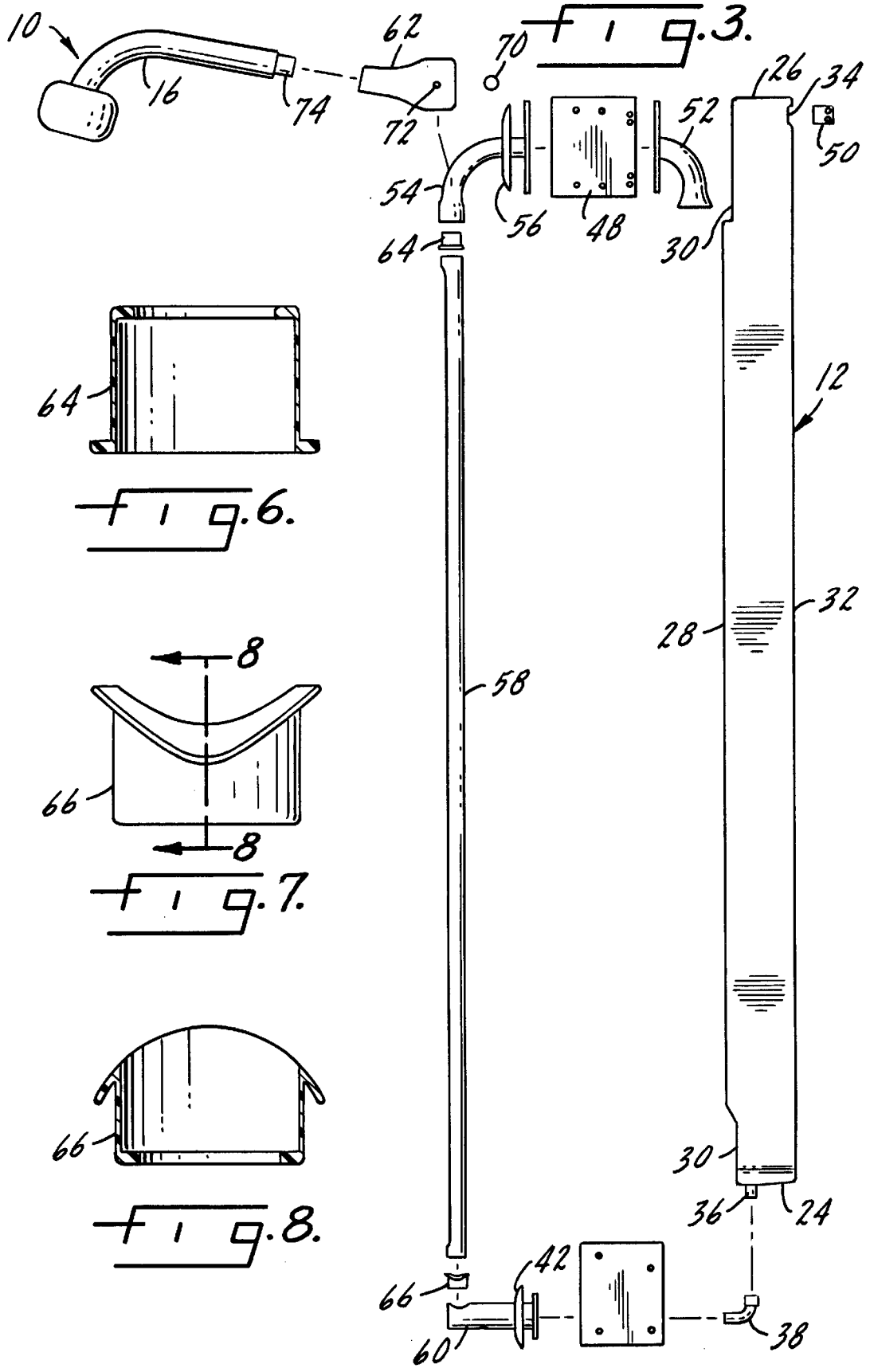
FIG. 3 is an exploded profile view of the invention shown in FIG. 1.
FIG. 6 is a section of an upper pivoting bearing.
FIG. 7 is a plan view of a lower pivoting bearing.
FIG. 8 is a section of the pivot bearing plane 8—8 of FIG. 7.

The shower arm assembly 20 incorporates adjustability features which allow the user to change the height of the shower head 16. The shower arm assembly 20 is positioned in front of the shower wall 22 close to the user and includes a track 58, a base 60 and a shower arm 62. The track 58 is U-shaped with the top portion thereof defining a hose sized aperture to receive the hose therein as the hose exits hose sleeve 54. The hose sized aperture is located away from the shower wall 22 and is visible to the user. In FIGS. 3, 6 and 7, an upper pivot bearing 64 and a lower pivot bearing 66 are located at each end of the track 58 to allow the track to pivot along its length. The base 60 receives the lower end the track 58 and provides support to the shower arm assembly 20. The base 60 may have one or more drain holes 68 to allow any water from the track to drain downwards. The base 60 is secured behind the shower wall 22 where it receives the drain hose 38. Thus the base also permits drainage of accumulated water from within the housing.

Figure 2:
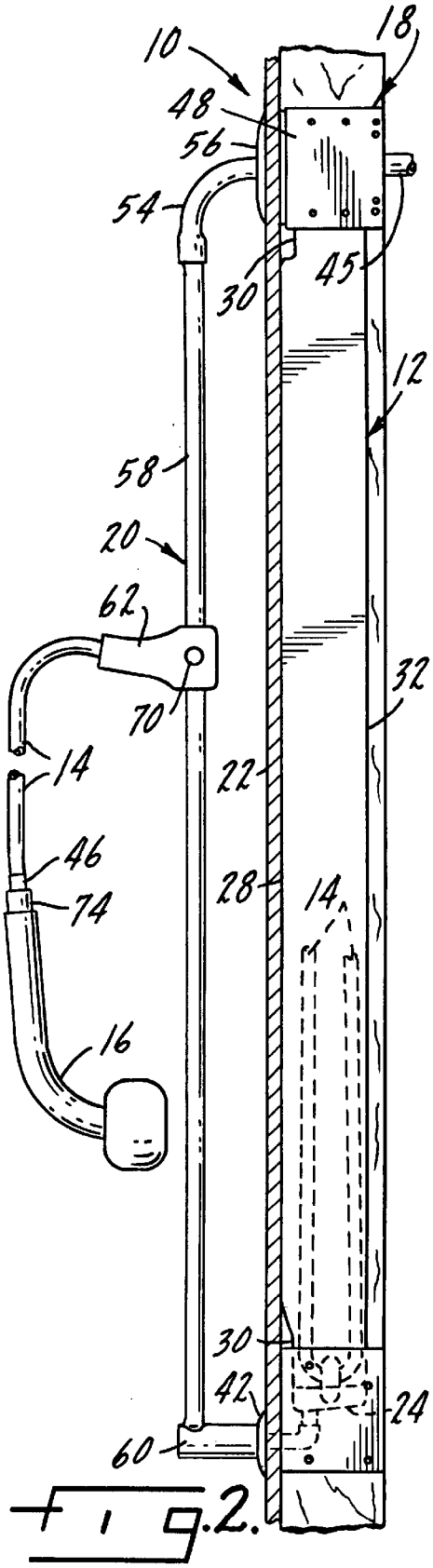
FIG. 2 is a side view of the invention shown in FIG. 1 adding the position of a shower wall.

In FIGS. 2 and 3, the shower arm 62 slidably engages the track to receive the hose 14 as it extends outward from the track 58. The shower arm 62 position is controlled by a pin 70 inserted into a pin hole 72 which is located on the shower arm. When inserted into the pin hole 72 by the user, the pin 70 stops the shower arm 62 at a desired position along the track 58. After the hose 14 passes through the shower arm 62, it connects with a distal end 74 of the shower head 16. The shower arm assembly 20 thus provides for shower height positioning anywhere along the track. When a new shower height is desired by the user, the shower arm is repositioned by removing the pin, moving the shower arm up or down to the desired user height and reinserting the pin.

Figure 9:
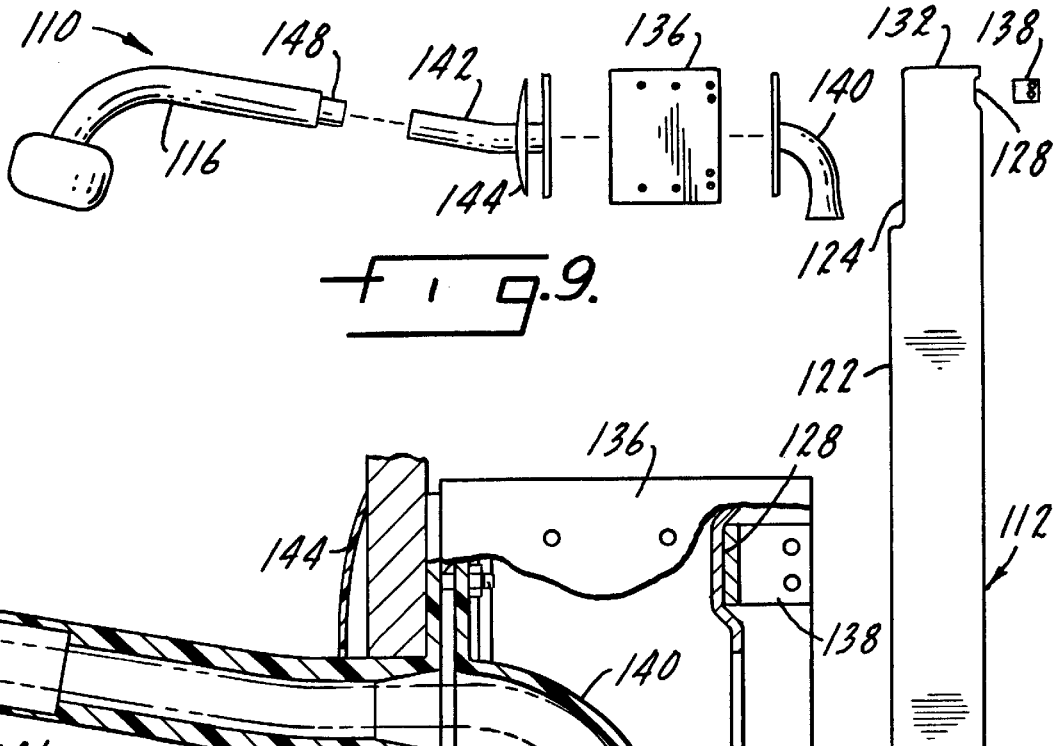
FIG. 9 is an exploded profile view of a shower assembly with a fixed height.
Figure 10:
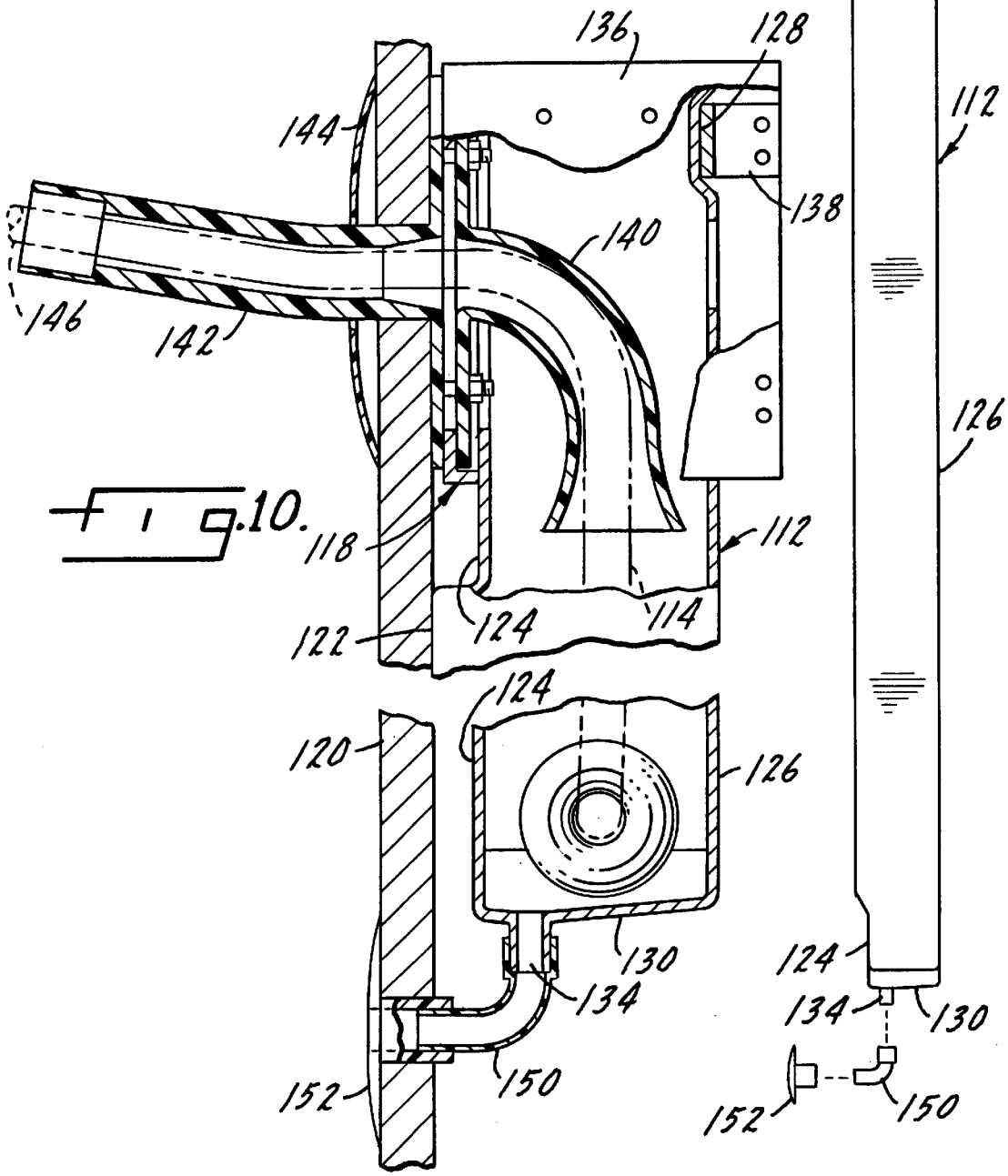
FIG. 10 is a enlarged partial side view, in part section of the shower assembly of FIG. 9.

The shower assembly 110 in FIGS. 9 and 10 is similar to that in FIGS. 1–5 except it uses a fixed shower height. Similarly, the assembly 110 has a housing 112 with a hose 114 (shown as dotted line) freely positioned therein, a shower head 116, and a supporting section 118. Behind a shower wall 120, the housing has a front 122 with one or more recesses 124, a rear wall 126 with a recess 128, a bottom 130, a top 132, a drain outlet 134, a U-shaped member 136, a rear element 138, and one or more housing hose sleeves 140, 142 which are secured to the U-shaped member. As the hose 114 transverses the shower wall 120, it extends through hose sleeve 142 which provides a fixed, upwardly extending shower arm. The hose sleeve 142 conceals the hose 114 as it emerges from the shower wall 120 and gives the hose a smoother transition there through. Where the sleeve 142, protrudes from the shower wall 120, an escutcheon 144 may be used. On the exposed side of the shower wall 120, a hose second end 146 is securely attached to a distal end 148 of the shower head 116. Behind the shower wall adjacent the housing bottom 130, a drain hose 150 connects the housing drain outlet 134 to a fluid outlet 152 on the exposed side of the shower wall 120 such that water accumulation within the housing is directed to the exposed side thereof. The fluid outlet 152 may be combined with an escutcheon.

The hose 114 is extractable from the housing 112 behind the shower wall 120 when the user pulls on the hose second end 146. The hose 114 is retractable into the housing 112 when the user pushes the hose back through the shower wall. As the user extracts or retracts the hose 114, the shower head 116 moves with the hose. When not in hand-held use, the hose is concealed from the user's view. When the hose is retracted, the shower head functions as a stationary shower head. When the hose is extended, the shower head serves as a hand-held shower wand which is controlled by the user.

Whereas the preferred form of the invention has been shown and described herein, it should be realized that there may be many modifications, substitutions and alterations thereto. For example, the housing bottom may also be sloped from the rear wall toward the housing front. The shower arm may be directed at any angle such as an upward or downward angle, an angle away from the user or at an angle normal to the shower wall. Although the adjustable shower assembly track is shown parallel to the shower wall, the track or any portion thereof may be positioned at any angle with respect to the shower wall. For example, a portion of the guide bar near the guide bar tube may be angled to allow more hose bending room.

Further, the assembly may be supported by a plurality of structures. Possible supporting structures include but are not limited to sleeves, pipes, mounting brackets, shower arms, funnels, guide tubes and guide bars. Polished surfaces can be used for any or all of the assembly shower surfaces which contact the hose to minimize friction. The fixed shower assembly may use a lower mounting bracket to provide additional mounting support to the assembly.

Within the housing, a weight may be attached to the hose at a predetermined distance along the hose length. The weight may encircle the hose or be secured to the hose by any apparent means. The weight will act to stop the hose from being extracted to any hose position beyond the weight and will provide tension to the user when the hose is extracted for hand-held use. After the user is finished, the weight will tend to retract the hose as the user returns the hose into the housing.

What is claimed is:

1. A shower assembly for mounting on a shower wall which combines an adjustable height shower with a hand-held shower, including:

(a) a housing positioned behind the shower wall, said housing having an exterior surface and an internal cavity, said exterior surface being made of a plurality of sides, a bottom surface and a top cover, said internal cavity having an inlet, an outlet and a hose receiving interior;

(b) a shower head with an adjustable height;

(c) a hose having two ends and a predetermined length, one end of said hose being attached to a supply pipe at a connection located within the internal cavity such that all water leakage occurs therein, the other end of said hose being connected to the shower head on the exposed side of the shower wall, said hose length being disposed within the internal cavity and capable of free movement therein, said hose extending from the supply pipe to the shower head such that water is supplied to the shower head from the supply pipe; and (d) a supporting section being substantially positioned between the housing and the shower head and securely mounted therebetween to the shower wall, said supporting section having a visible portion and a hidden portion, said visible portion being disposed on the exposed side of the shower wall and providing an adjustable mount for the shower head, the hidden portion being concealed from view, said supporting section capable of threadably receiving the hose and providing mounting support to the assembly;

said hose being freely disposed within the internal cavity such that the hose is fully concealed behind the shower wall when said assembly is used as a stationary shower and said hose is freely extendible from the wall when the assembly is used as a hand-held shower, said shower height being adjustable during stationary and hand-held use.

2. The shower assembly of claim 1 wherein the supporting section visible portion further comprises a shower arm assembly, said shower arm assembly being capable of receiving the hose therein and having two ends each securely mounted to the shower wall, said shower arm assembly having a track with a hose sized aperture along a length thereof to allow bending of said hose there through at any position along the track, each track position corresponding to a desired user shower head height.

3. The shower assembly of claim 2 wherein the track is attached to a pivot bearing on each end thereof allowing the track to rotate therebetween.

4. The shower assembly of claim 2 said housing having a drain outlet which protrudes beyond a bottom edge of said housing and is attached to a drain hose, said drain hose protruding through an aperture in the shower wall and being in fluid engagement with a fluid outlet located on the exposed side of the shower wall, said fluid outlet being located in the bottom end of the guide bar assembly such that the water flow is directed to the exposed side of the shower wall and prevents water damage behind the shower wall.

5. The shower assembly of claim 1 said housing having an exterior surface first side being generally planar and located adjacent the shower wall, said first side having one or more recesses, one of said recesses being adjacent to the supporting section for receiving a portion thereof and assist positioning of the housing, a second side opposite to said first side having a second recess for receiving a housing bracket which assists support of the housing.

6. The shower assembly of claim 1 wherein the supporting section visible portion further comprises an adjustable shower arm to allow shower height adjustment.

7. The shower assembly of claim 6 wherein the shower head height adjustment is controlled by a pin inserted into the adjustable shower arm.

8. A shower assembly for mounting on a shower wall including:

(a) a housing positioned and concealed behind the shower wall and securely mounted thereto, said housing having an exterior surface and an internal cavity, said exterior surface being made of a plurality of sides, a bottom surface and a top cover, said internal cavity having an inlet, an outlet and a hose receiving interior;

(b) a shower head;

(c) a hose having two ends and a predetermined length, one end of said hose being attached to a supply pipe at a connection located within the internal cavity such that all water leakage occurs therein, the other end of said hose being connected to said shower head on the exposed side of the shower wall, said hose length being freely disposed within the internal cavity and capable of free movement therein, said hose extending from the supply pipe to the shower head and being in fluid engagement therebetween such that water is supplied to the shower head from the supply pipe; and (d) a supporting section being securely mounted to the shower wall and having a visible portion and a tubular hidden portion, the tubular hidden portion being concealed from view and downwardly extending into the internal cavity at the inlet, the tubular hidden portion terminating within the internal cavity at a distal end which is spaced in relation to the plurality of sides of the housing, the tubular hidden portion threadably receiving the hose and providing a smooth transition to the hose for extension and retraction of the hose;

said hose being freely disposed within the internal cavity such that the hose is fully concealed behind the shower wall when said assembly is used as a stationary shower and said hose is freely extendible from the wall when the assembly is used as a hand-held shower.

9. The shower assembly of claim 8 wherein the tubular hidden portion has a curved shape and defines a passage which is perpendicular to the shower wall at the internal cavity inlet and parallel to the shower wall at the distal end, the distal end defining a funnel shaped opening.

10. The shower assembly of claim 8 wherein the supporting section further comprises a shower arm.

11. The shower assembly of claim 10 wherein the shower arm is adjustable to allow shower height adjustment.

12. The shower assembly of claim 10 wherein the shower arm is fixed to provide a fixed shower height.

* * * * *